United States Patent [19]

Maake

[11] 3,991,298

[45] Nov. 9, 1976

[54] HEATING UNIT FOR A CERAMIC TOP ELECTRIC RANGE

[75] Inventor: Douglas Herman Maake, Cookeville, Tenn.

[73] Assignee: Gould Inc., Rolling Meadows, Ill.

[22] Filed: July 28, 1975

[21] Appl. No.: 599,391

[52] U.S. Cl. ..... 219/464; 219/460; 219/463; 219/467; 338/282

[51] Int. Cl.[2] ..... H05B 3/68

[58] Field of Search ..... 219/265, 370, 460, 452, 219/463, 464, 467, 532, 382; 338/278, 279, 280, 281, 282, 297, 303

[56] References Cited

UNITED STATES PATENTS

| | | | |
|---|---|---|---|
| 600,057 | 3/1898 | Ball | 338/280 |
| 1,842,972 | 1/1932 | Ipsen et al. | 338/280 |
| 3,136,885 | 6/1964 | Hynes | 219/382 |
| 3,381,109 | 4/1968 | Youhouse | 219/265 |
| 3,636,309 | 1/1972 | Deaton et al. | 219/452 |
| 3,710,076 | 1/1972 | Frazier | 219/464 X |
| 3,749,883 | 6/1973 | Vodvarka et al. | 219/463 |
| 3,819,903 | 6/1974 | Frick | 219/464 |
| 3,833,793 | 9/1974 | McWilliams et al. | 219/464 |
| 3,835,435 | 9/1974 | Seel | 219/532 X |
| 3,898,426 | 8/1975 | Maalic | 219/370 |

FOREIGN PATENTS OR APPLICATIONS

| | | | |
|---|---|---|---|
| 195,969 | 4/1922 | United Kingdom | 219/464 |

*Primary Examiner*—Volodymyr Y. Mayewsky
*Attorney, Agent, or Firm*—Edward E. Sachs

[57] ABSTRACT

A heating element assembly for a ceramic top electric range is disclosed. The assembly includes a base pod comprising a block of insulating material having a recess in one surface. A grooved path is formed in the recess in the form of a spiral and a thin, flat strip of apertured, foil-like, electrical resistance material is inserted in the grooved path. That strip is only partially received by the groove so that a major portion of its width projects toward but not beyond a plane defined by the face of the block. Electrical terminals are provided at the ends of the strip and the block is adhered to the bottom surface of the ceramic top to encapsulate the heating element.

3 Claims, 2 Drawing Figures

HEATING UNIT FOR A CERAMIC TOP ELECTRIC RANGE

BACKGROUND OF THE INVENTION

This invention generally relates to heating element assemblies for electric ranges and, more particularly, to a heat element assembly for a smooth surface ceramic top electric range. Prior art heating element assemblies for such ranges include an insulating pod with a recess therein and a helically coiled heating element wrapped in a spiral manner within the recess. The element is attached to the floor of the recess by a suitable adhesive. Another prior art arrangement is shown in U.S. Pat. No. 3,749,883, and includes an insulating pod having a recess therein which receives a tubular electric heating element which is shaped to a flat spiral. A metallic support member is formed of strip metal positioned on edge and bent to provide a pair of legs connected by a bite portion. As is recognized by the patentees of that patent, difficulty has been encountered in the design of an electric heater for use with a ceramic panel because the composition of the latter becomes unstable under excessive heat and discolors or fractures. Attempts have been made to overcome this problem and have met with a certain degree of success. The patentees also recognize that such attempts have resulted in costly assemblies, and attention has been directed by those patentees to utilize a sheathed, tubular electric heating element providing a flat, spiral heating surface. They also recognize that the tubular electric heating element is relatively expensive, but their low-cost assembly technique offsets the increased cost of the heating element.

SUMMARY OF THE INVENTION

This invention provides a heating element for a ceramic smooth top electric range which employs an inexpensive electric resistance heating element and involves a simplified and less expensive assembly technique.

The electric resistance heating element is a thin strip of apertured, foil-like material, and is preferably a strip of expanded metal. That element is received within a recess formed in a nonconductive, insulating base. The floor of the recess has a groove cut or molded therein in a desired heating pattern, and the groove receives one edge of the strip so that a major portion of the strip projects from the floor toward but not beyond a plane defined by the upper surface of the block. Terminals are connected to the ends of the resistance element, and the upper surface of the block is adhered to a ceramic heating surface. Thus, no attaching means is required between the heating element and its supporting insulating block, and this greatly reduces the cost of assembly. Also, since the heating element itself is an inexpensive item, costs are further reduced.

DETAILED DESCRIPTION OF THE INVENTION

Figure 1:
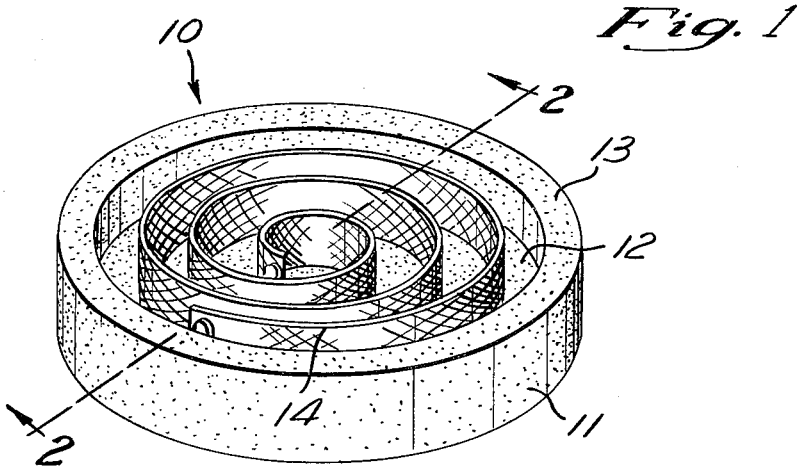
FIG. 1 is a perspective view of an assembly according to this invention.
Figure 2:
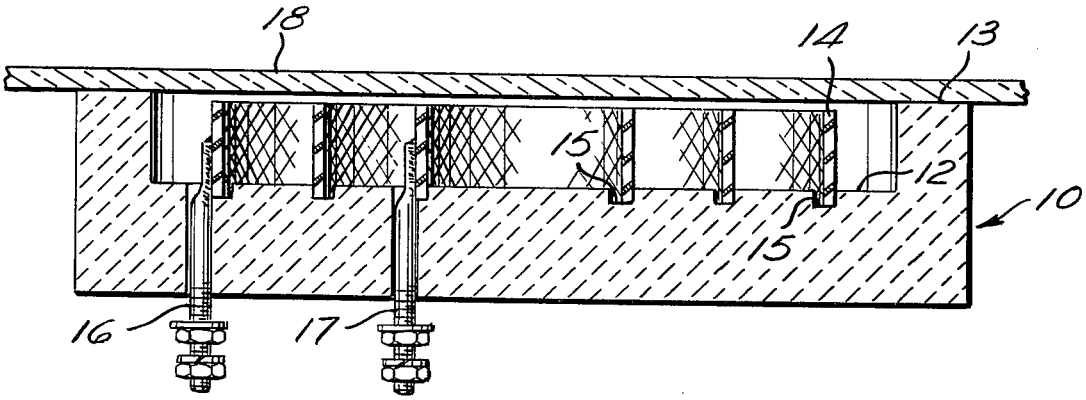
FIG. 2 is a cross sectional view of the assembly shown in FIG. 1, illustrating the assembly adhered to a ceramic cooking surface.

Referring now to the drawing, there is illustrated a heating element assembly 10 which includes a block of insulating material 11. The block 11 may be molded from a suitable inorganic refractory material, and has a face 12 from which a wall 13 projects. The wall 13 and face 12 define a recess within which a thin, flat strip of apertured, foil-like electrical resistance material 14 is positioned.

The material 14 is a commercially available material, having electric resistance characteristics. The material 14 as shown in the drawing has a diamond-shaped, expanded metal configuration. The expansion of the metal may be accomplished by first slitting the solid foil strip intermittently so that the entire sheet has a series of closely spaced, parallel cuts to permit expanding it laterally to form the open screen. Furthermore, the material may be formed by repeatedly impacting and shearing diamond-shaped openings in the foil by conventional machinery. The resulting material has a high surface area-to-mass ratio and a faster heat-up and cooling rate as compared to a coiled heating element of the prior art. This high surface area-to-mass ratio offers more radiation and allows the unit to reach operating temperature in approximately three seconds, as compared to 4.5 minutes for a helical coil. The element also has a rapid cool-down time and requires only 66% of the power previously required to reach a designated operating temperature.

There is provided a grooved path 15 in the recess which, in the illustrated embodiment of the invention, follows a spiral path. It should be understood, however, that other paths, such as zig-zag or serpentine, may be employed without departing from the scope of the invention. An edge of the material 14 is inserted in the path 15 and therefore forms a spiral as indicated in FIG. 1. A major portion of the material 14 is exposed so that the major portion of the strip is utilized as a heat-emitting member.

The ends of the material 14 are respectively connected to terminal posts 16 and 17, as by spot welding or the like.

The assembly 10 may then be adhered to a ceramic cooking top 18 with a suitable cement.

Desirably, the distance between the top edge of the material 14 and the bottom surface of the cooking surface 18 is less than the depth of the path 15 so that the material 14 will be effectively locked in place during use and will have no tendency to be dislodged from the path upon expansion and contraction during use.

While there have been described what are at present considered to be the preferred embodiments and aspects of this invention, it will be obvious to those skilled in the art that various changes and modifications may be made therein without departing from the invention, and it is intended, therefore, in the appended claims to cover all such changes and modifications as fall within the true spirit and scope of the invention.

What is claimed is:

1. A heating element assembly for a ceramic top electric range comprising a block of insulating material, a face of said block having a wall projecting therefrom to define a recessed circular floor in said block, means defining a grooved path in said recessed floor which follows a coiled heating path, a thin, flat strip of apertured foil-like electrical resistance material inserted in said grooved path and having the major portion of its width projecting from said grooved path and toward but not beyond a plane defined by the top of said wall, the distance between the top edge of said material and said plane being less than the depth of said grooved path, and electrical terminals attached to the ends of said strip and extending outside of said insulating block.

2. A heating element assembly according to claim 1, wherein said desired heating path is spiral.

3. A heating element assembly according to claim 1, wherein said material is an expanded metal foil grid.

* * * * *